US010082112B2

(12) United States Patent
Nakamura et al.

(10) Patent No.: US 10,082,112 B2
(45) Date of Patent: Sep. 25, 2018

(54) GAS DISTRIBUTION APPARATUS

(71) Applicant: AISAN KOGYO KABUSHIKI KAISHA, Obu-shi, Aichi-ken (JP)

(72) Inventors: Takehide Nakamura, Handa (JP); Daigo Oyabu, Chiryu (JP)

(73) Assignee: AISAN KOGYO KABUSHIKI KAISHA, Obu-Shi (JP)

( * ) Notice: Subject to any disclaimer, the term of this patent is extended or adjusted under 35 U.S.C. 154(b) by 0 days.

(21) Appl. No.: 15/413,775

(22) Filed: Jan. 24, 2017

(65) Prior Publication Data

US 2017/0226968 A1 Aug. 10, 2017

(30) Foreign Application Priority Data

Feb. 8, 2016 (JP) ..... 2016-021577

(51) Int. Cl.
*F02M 26/00* (2016.01)
*F02M 26/20* (2016.01)

(52) U.S. Cl.
CPC ..... *F02M 26/20* (2016.02)

(58) Field of Classification Search
CPC ..... F02M 26/20
See application file for complete search history.

(56) References Cited

U.S. PATENT DOCUMENTS 5,014,654 A * 5/1991 Ishibashi ..... F02M 35/10222 123/184.38
6,334,437 B1 * 1/2002 Jessberger ..... F02M 35/10085 123/568.12
6,553,978 B2 * 4/2003 Takashiba ..... F02M 25/06 123/568.15
9,057,346 B2 * 6/2015 Sato ..... F02M 35/10072
9,359,980 B2 * 6/2016 Tochizawa ..... F02M 35/10026
2005/0039730 A1 * 2/2005 Nishida ..... F02M 35/10085 123/568.17
2006/0191505 A1 * 8/2006 Doko ..... F02M 35/10039 123/184.59
2013/0306041 A1 * 11/2013 Koga ..... F02M 25/07 123/568.11

FOREIGN PATENT DOCUMENTS

JP 2000-192860 A 7/2000
JP 2005-083312 A 3/2005
JP 2006-241992 A 9/2006
JP 2015-148188 A 8/2015

* cited by examiner

*Primary Examiner* — Hieu T Vo
*Assistant Examiner* — Sherman Manley
(74) *Attorney, Agent, or Firm* — Oliff PLC

(57) ABSTRACT

A gas distribution unit includes four EGR inflow ports connected one to each of a plurality of branch pipes of an intake unit provided with a collecting pipe and the branch pipes, a EGR chamber located upstream of and connected to the EGR inflow ports, and a branch passage part located upstream of and connected to the EGR chamber to uniformly distribute EGR gas introduced through a gas inflow port into the EGR chamber.

8 Claims, 10 Drawing Sheets

XX: PRESSURE

YY: EGR CONCENTRATION

GAS DISTRIBUTION APPARATUS

CROSS-REFERENCE TO RELATED APPLICATIONS

This application is based upon and claims the benefit of priority from the prior Japanese Patent Application No. 2016-021577 filed on Feb. 8, 2016, the entire contents of which are incorporated herein by reference.

BACKGROUND

Technical Field

The present invention relates to a gas distribution apparatus and more particularly to a gas distribution apparatus to be used for example to distribute and supply EGR gas to an intake system.

Related Art

Heretofore, an intake apparatus is provided with a gas distribution apparatus for distributing EGR gas which is a part of exhaust gas to a plurality of cylinders of an engine for recirculation of the EGR gas in order to reduce harmful substances contained in the exhaust gas, improve fuel consumption, and so on.

One example of such a gas distribution apparatus has been proposed as an exhaust gas recirculation (EGR) apparatus for an engine disclosed in for example Japanese unexamined patent application publication No. 2005-83312 (JP 2005-83312 A). This EGR apparatus is configured such that a connecting part that connects an upstream collecting passage and a chamber and a connecting part that connects the chamber and an EGR branch passage are disposed at offset positions in a direction perpendicular to a cylinder arrangement direction when seen in the cylinder arrangement direction, to uniformly distribute the exhaust gas to be recirculated ("recirculating exhaust gas").

SUMMARY

Technical Problems

However, in the EGR apparatus for an engine disclosed in JP 2005-83312 A, the upstream collecting passage is connected to one end in a longitudinal direction of the chamber without branching out. Thus, the recirculating exhaust gas to be introduced into the chamber through the upstream collecting passage could not be supplied uniformly throughout the inside of the chamber. This results in non-uniform distribution of the recirculating exhaust gas in the chamber. Consequently, the recirculating exhaust gas may not be distributed uniformly from the chamber to EGR branch passages.

The present invention has been made to solve the above problems and has a purpose to provide a gas distribution apparatus capable of uniformly distributing gas to a gas supply destination.

Means of Solving the Problems

To achieve the above purpose, one aspect of the invention provides a gas distribution apparatus comprising: a gas inflow port through which gas will be introduced into the gas distribution apparatus; a plurality of downstream-side gas distributing passages to be connected one to each of a plurality of branch pipes of an intake unit provided with a collecting pipe and the plurality of branch pipes branching off from the collecting pipe; a volume chamber located on an upstream side of the plurality of downstream-side gas distributing passages and connected to the downstream-side gas distributing passages; and an upstream-side gas distributing passage located on an upstream side of the volume chamber, the upstream-side gas distributing passage being connected on one end side to the gas inflow port and connected on another end side to the volume chamber, and the upstream-side gas distributing passage being configured to allow the gas introduced through the gas inflow port to be uniformly distributed and introduced into the volume chamber.

The above configuration can uniformly introduce gas from the upstream-side gas distributing passage to the volume chamber to thereby achieve uniform distribution of gas in the volume chamber. Further, the above configuration can achieve uniform distribution of gas from the volume chamber to the plurality of downstream-side gas distributing passages, leading to uniform supply to a gas supply destination.

DETAILED DESCRIPTION OF THE EXEMPLARY EMBODIMENTS

A detailed description of an embodiment of a gas distribution apparatus according to the present invention will now be given referring to the accompanying drawings. This embodiment exemplifies that the invention is applied to an intake manifold provided with a gas passage to introduce a large amount of EGR by use of an EGR cooler to a four-cylinder, naturally-aspirated engine. In the following description, the term "upstream side" indicates an upstream side in a flow direction of EGR gas and the term "downstream side" indicates a downstream side in the flow direction of EGR gas.

Figure 1:
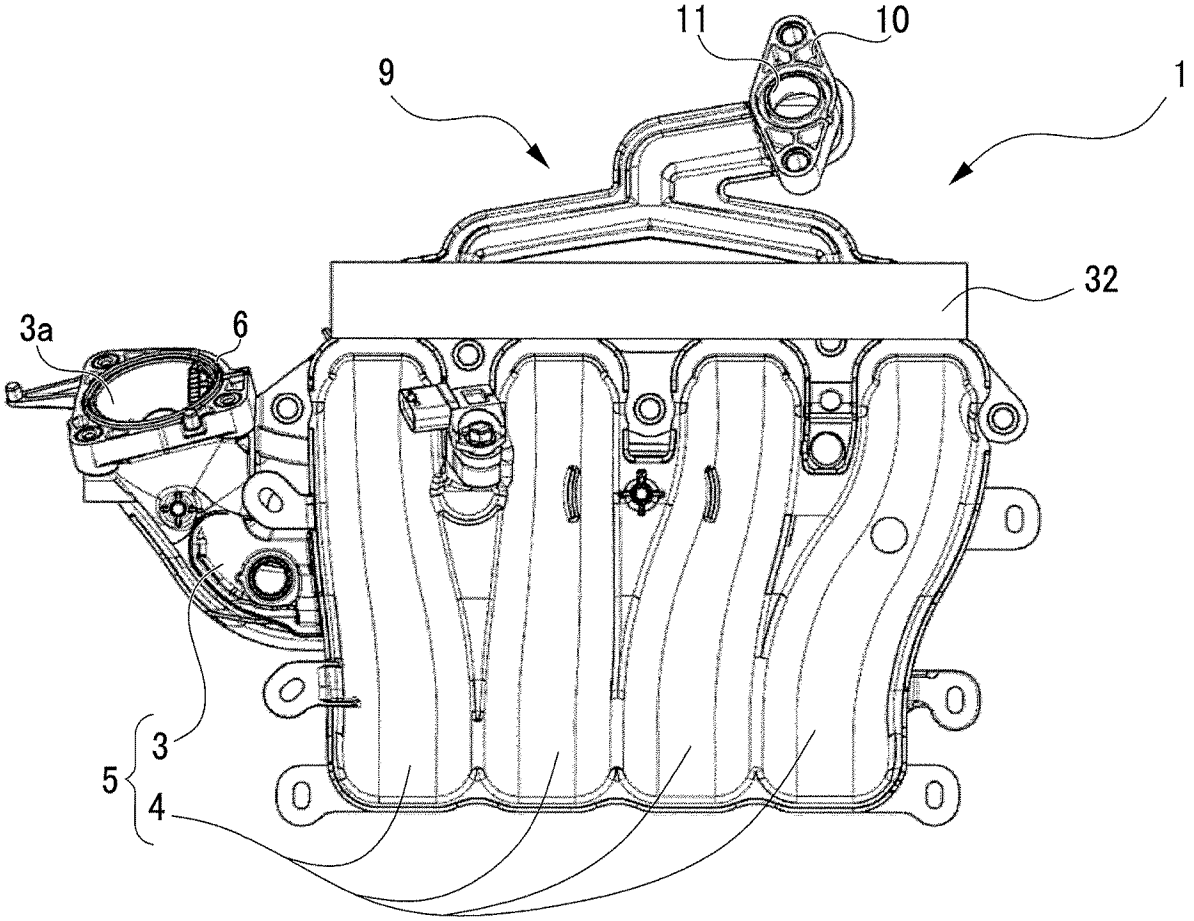
FIG. 1 is a front view of an intake manifold in a present embodiment.
Figure 2:
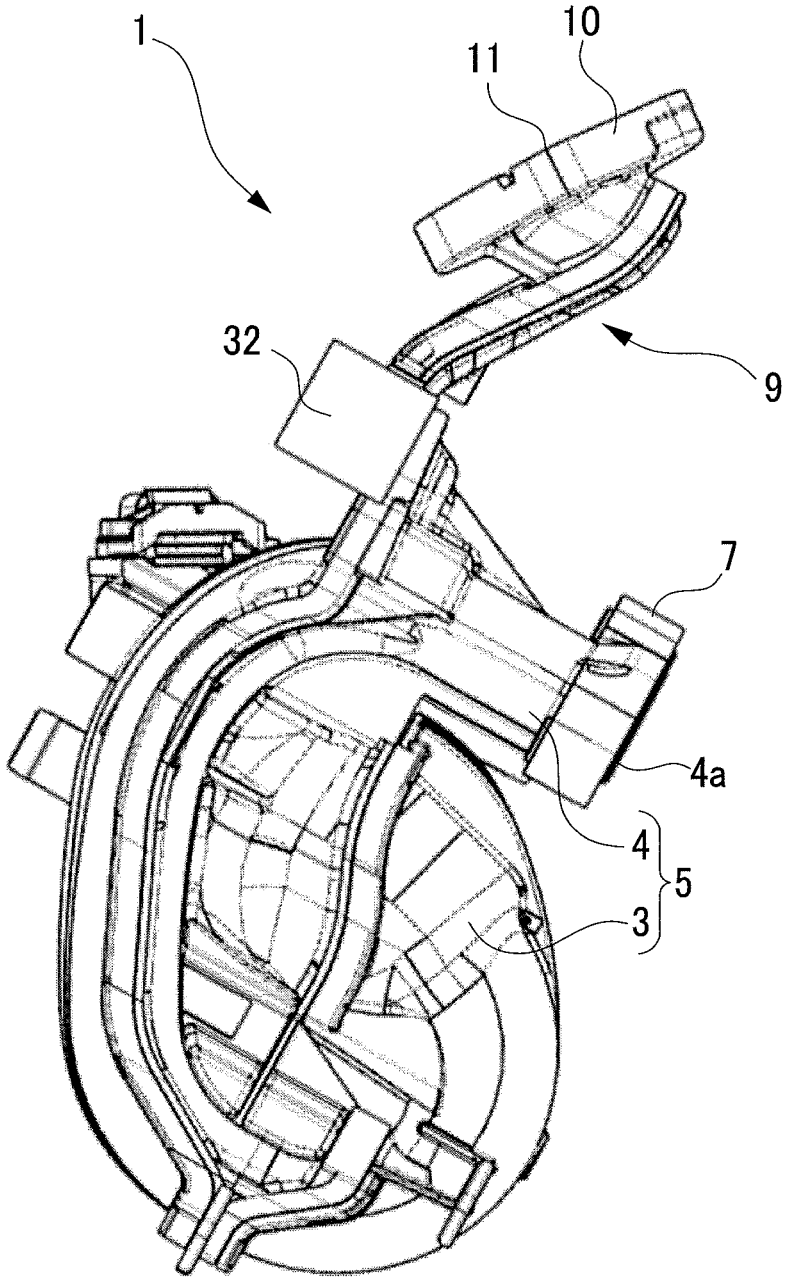
FIG. 2 is a right side view of the intake manifold shown in FIG. 1.

An intake manifold 1 in the present embodiment will be mounted and used in an engine (not shown) to introduce air and EGR gas into each EGR inflow port of the engine. As shown in FIGS. 1 and 2, the intake manifold 1 is provided with a collecting pipe 3 to be connected to an air cleaner or the like, and a plurality of branch pipes 4 branching off from the collecting pipe 3. Specifically, the intake manifold 1 in the present embodiment includes four branch pipes 4 corresponding to the four-cylinder engine. FIGS. 1 and 2 show an intake manifold 1 in an installation state (an attachment state or a use state) in the engine.

The collecting pipe 3 has an inlet 3*a* formed with a flange 6. This flange 6 is connected to a throttle body provided with a throttle valve, and so on. The intake manifold 1 is provided, on its back side, with a flange 7 to be connected to the engine. In this flange 7, an outlet 4*a* of each of the branch pipes 4 is opened. Near the outlets 4*a* of the branch pipes 4, that is, near the flange 7, there is provided a gas distribution unit 9 internally formed with a gas passage 8 (see FIG. 3) to allow a part of exhaust gas (EGR gas) discharged from the engine to return to an intake system of the engine. The gas distribution unit 9 is formed integrally with an intake unit 5 including the collecting pipe 3 and the branch pipes 4. It is to be noted that the gas distribution unit 9 is one example of a "gas distribution apparatus" of the present invention.

This gas distribution unit 9 is provided to be located on a top side of each branch pipe 4, namely, an upper side of the intake manifold 1 during use of the intake manifold 1, that is, while the intake manifold 1 is attached to the engine and this engine is installed in a vehicle. The gas distribution unit 9 has a flat plate-like shape protruding obliquely upward on the upper side of the intake manifold 1. An upper end of the gas distribution unit 9 is provided with a flange 10. A single gas inflow port 11 through which EGR gas will be introduced into the intake manifold 1 is provided at an end of the gas passage 8 so as to open in the flange 10. The flange 10 is connected to an EGR valve. This EGR valve functions to control a flow rate of EGR gas so that a controlled flow rate of the EGR gas is recirculated to the intake system through the gas passage 8.

Figure 3:
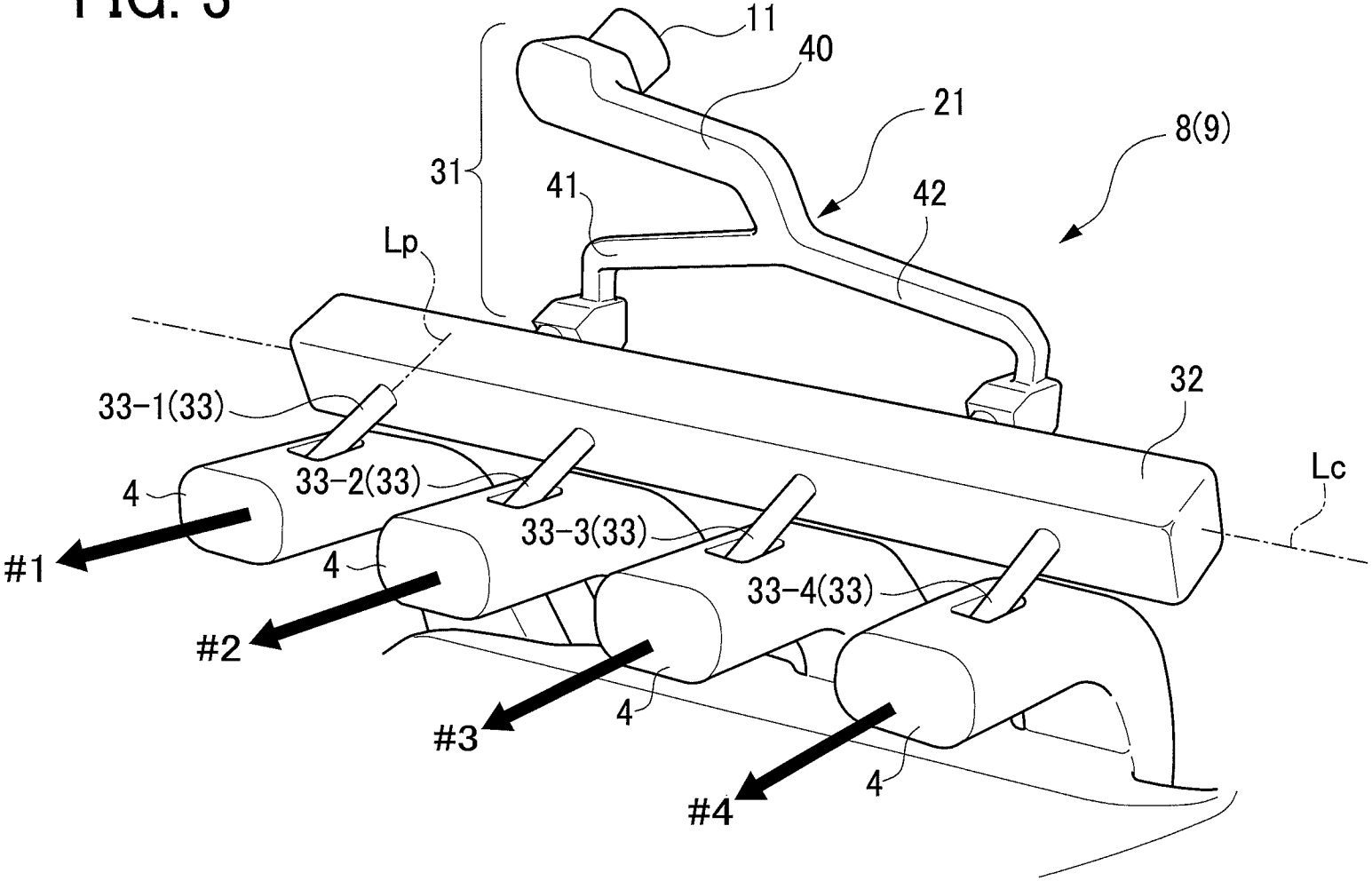
FIG. 3 is a model diagram of a gas passage in the present embodiment.

As shown in FIG. 3, the gas distribution unit 9 includes the single gas inflow port 11 and the passage 8 extending from the gas inflow port 11 to the branch pipes 4 by branching into a plurality of branch passages. The gas passage 8 is provided with a branch passage part 31, an EGR chamber 32, and EGR inflow ports 33. The branch passage part 31 corresponds to one example of an "upstream-side gas distributing passage", the EGR chamber 32 corresponds to one example of a "volume chamber", and the EGR inflow ports 33 correspond to one example of "downstream-side gas distributing passages" in the present invention.

The branch passage part 31 is located on an upstream side of the EGR chamber 32 and connected on one end side to the gas inflow port 11 and on the other end side to the EGR chamber 32. The branch passage part 31 has a shape extending from the gas inflow port 11 to the EGR chamber 32 by branching at a branch portion 21 into two passages. The branch passage part 31 includes an EGR inflow passage 40, a first branch passage 41, and a second branch passage 42. This branch passage part 31 is configured to allow the EGR gas introduced through the gas inflow port 11 to be uniformly distributed to the first branch passage 41 and the second branch passage 42 through the EGR inflow passage 40 and then flow to the EGR chamber 32.

The EGR chamber 32 is located on the upstream side of the four EGR inflow ports 33 and connected to these EGR inflow ports 33. The details of the EGR chamber 32 will be explained later.

The EGR inflow ports 33 are connected one to each of the branch pipes 4. In the present embodiment, the EGR inflow ports 33 include a first EGR inflow port 33-1, a second EGR inflow port 33-2, a third EGR inflow port 33-3, and a fourth EGR inflow port 33-4. These first EGR inflow port 33-1, second EGR inflow port 33-2, third EGR inflow port 33-3, and fourth EGR inflow port 33-4 are respectively connected through the branch pipes 4 to a first cylinder #1, a second cylinder #2, a third cylinder #3, and a fourth cylinder #4 of the engine.

In the present embodiment, the gas distribution unit 9 includes the EGR chamber 32 as described above. This EGR chamber 32 is explained in detail below.

Figure 11:
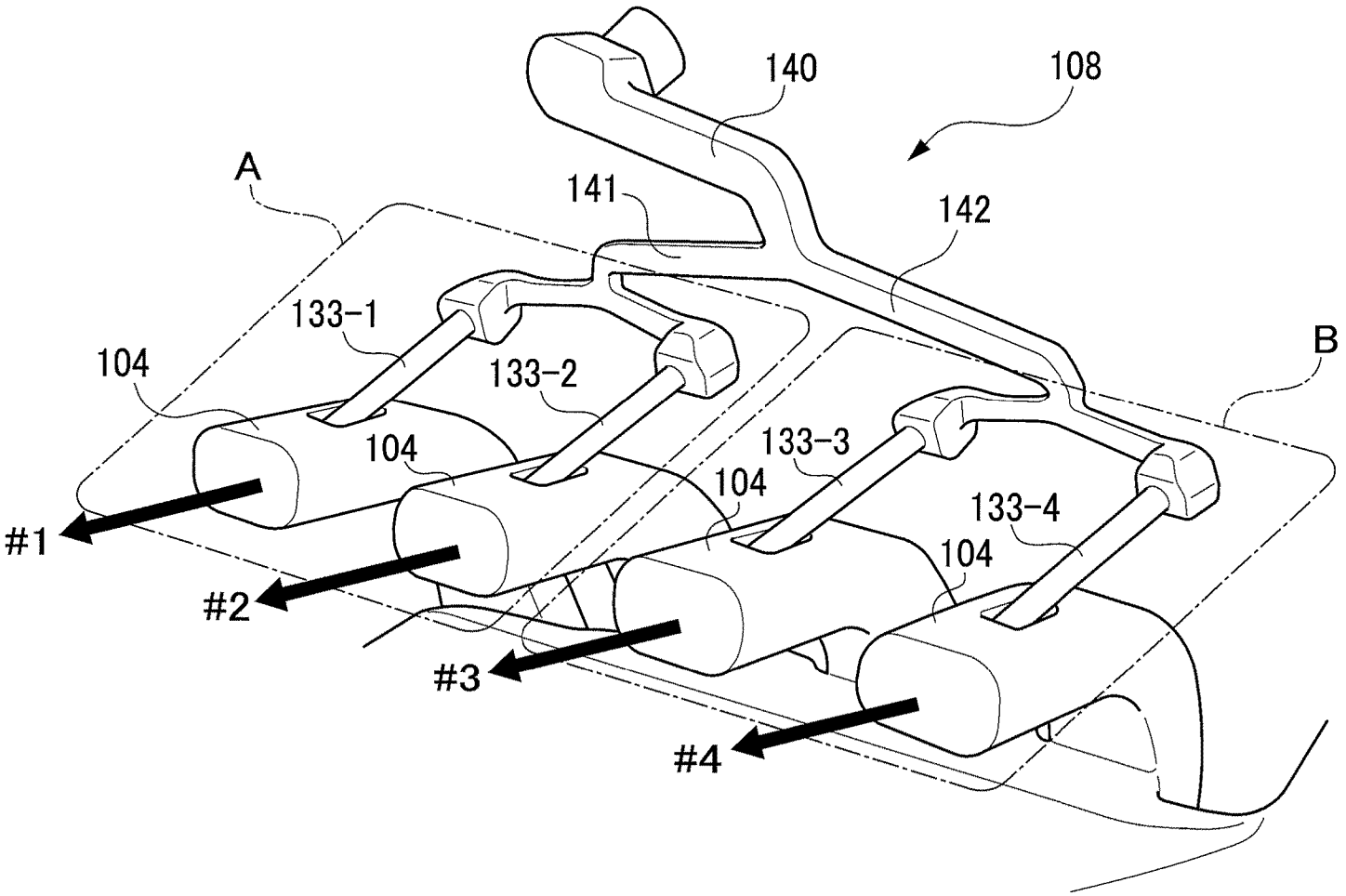
FIG. 11 is a model diagram of a gas passage in a first comparative example.

Herein, the following description is given on the presumption that a gas distribution unit is provided with no EGR chamber in a gas passage. For example, a gas passage 108 shown in FIG. 11 is described as a first comparative example. In this gas passage 108, an EGR inflow passage 140 is branched into two branch passages; a first branch passage 141 and a second branch passage 142. Further, the first branch passage 141 is branched into two passages connected to a first EGR inflow port 133-1 and a second EGR inflow port 133-2. The second branch passage 142 is branched into two passages connected to a third EGR inflow port 133-3 and a fourth EGR inflow port 133-4. These first EGR inflow port 133-1, second EGR inflow port 133-2, third EGR inflow port 133-3, and fourth EGR inflow port 133-4 are respectively connected through the branch pipes 104 to a first cylinder #1, a second cylinder #2, a third cylinder #3, and a fourth cylinder #4 of an engine.

The gas passage 108 configured as above is divided into two passage groups, namely, a block A corresponding to the first branch passage 141 and a block B corresponding to the second branch passage 142. To be specific, the block A includes the first EGR inflow port 133-1 and the second EGR inflow port 133-2 and the block B includes the third EGR inflow port 133-3 and the fourth EGR inflow port 133-4.

For instance, assuming that the ignition sequence of the engine (i.e., the order of cylinders to undergo an intake stroke) is the first cylinder #1, the third cylinder #3, the fourth cylinder #4, and the second cylinder #2, shifting of the intake stroke (i.e., switchover of a target cylinder for the intake stroke) from the third cylinder #3 to the fourth cylinder #4 is performed within the same, single block B, and shifting of the intake stroke from the second cylinder #2 to the first cylinder #1 is performed within the same, single block A. However, shifting of the intake stroke from the first cylinder #1 to the third cylinder #3 and shifting of the intake stroke from the fourth cylinder #4 to the second cylinder #2 are performed across the different blocks A and B.

Figure 12:
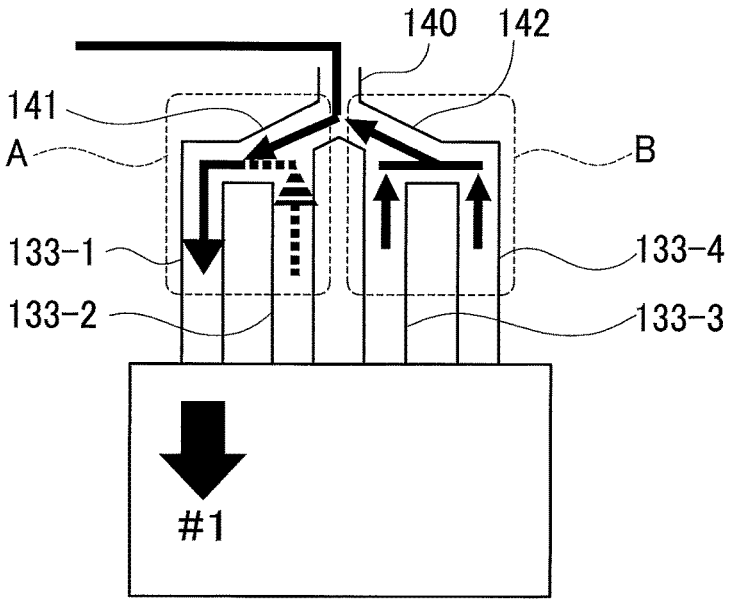
FIG. 12 is a schematic diagram showing a flow of EGR gas during an intake stroke of a first cylinder in the first comparative example.
Figure 13:
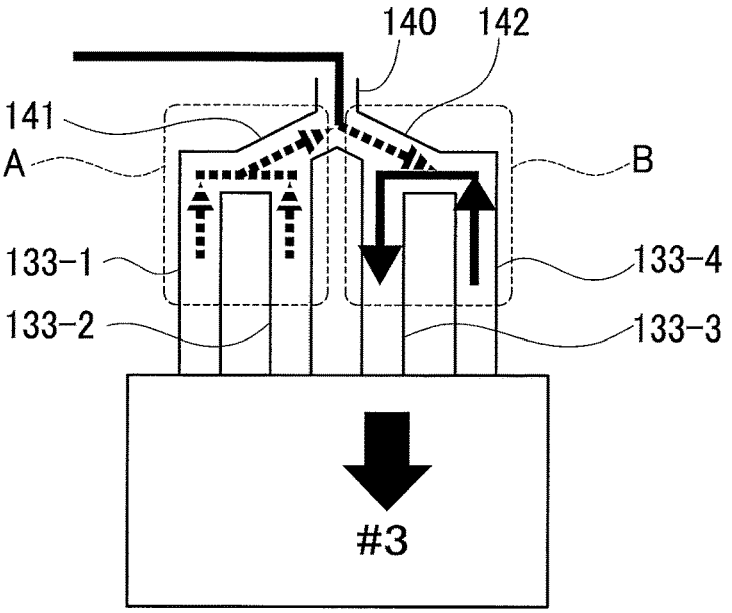
FIG. 13 is a schematic diagram showing a flow of EGR gas during an intake stroke of a third cylinder in the first comparative example.

Accordingly, at the time of shifting the intake stroke from the first cylinder #1 to the third cylinder #3, for example, a flow direction of EGR gas in the first branch passage 141 and the second branch passage 142 is reversed as indicated by solid arrows in FIG. 12 and broken arrows in FIG. 13. This reversal of the flow direction leads to a decrease in flow rate of EGR gas to be supplied to the third EGR inflow port 133-3, so that an EGR rate in the third EGR inflow port 133-3 decreases or drops. Further, at the time of shifting the intake stroke from the fourth cylinder #4 to the second cylinder #2, similarly, the EGR rate in the second EGR inflow port 133-2 also decreases. The EGR rate represents a percentage of EGR gas in a total intake air amount.

In the intake stroke of each cylinder, the valve opening times (periods) of the cylinders overlap each another between the cylinders. Thus, in the block A or block B, the flow rate of EGR gas to be supplied to the EGR inflow port 133 connected to the cylinder undergoing a next intake stroke is larger than the flow rate of EGR gas to be supplied to the EGR inflow port 133 connected to the cylinder undergoing a previous intake stroke. For instance, during shifting of the intake stroke from the first cylinder #1 to the third cylinder #3, at the time when the valve opening time of the first cylinder #1 and the valve opening time of the third cylinder #3 overlap each other and the first cylinder #1 and the third cylinder #3 are both brought into a negative pressure state, the EGR gas is allowed to flow to the block A and the block B. Accordingly, the flow rate of EGR gas to the third EGR inflow port 133-3 decreases, resulting in a decrease in EGR rate in the third EGR inflow port 133-3. On the other hand, during shifting of the intake stroke from the third cylinder #3 to the fourth cylinder #4, at the time when the valve opening time of the third cylinder #3 and the valve opening time of the fourth cylinder #4 overlap each other and the third cylinder #3 and the fourth cylinder #4 are both brought into a negative pressure state, the EGR gas is allowed to flow to the block B. Accordingly, the flow rate of EGR gas to the fourth EGR inflow port 133-4 does not decrease and thus the EGR rate in the fourth EGR inflow port 133-4 does not decrease. The same applies to the first cylinder #1 and the second cylinder #2.

For the aforementioned reasons, the gas distribution unit having no EGR chamber in the gas passage causes variations in the flow rate of EGR gas to the EGR inflow ports 133. Thus, the EGR gas could not be distributed uniformly to the EGR inflow ports 133.

Figure 4:
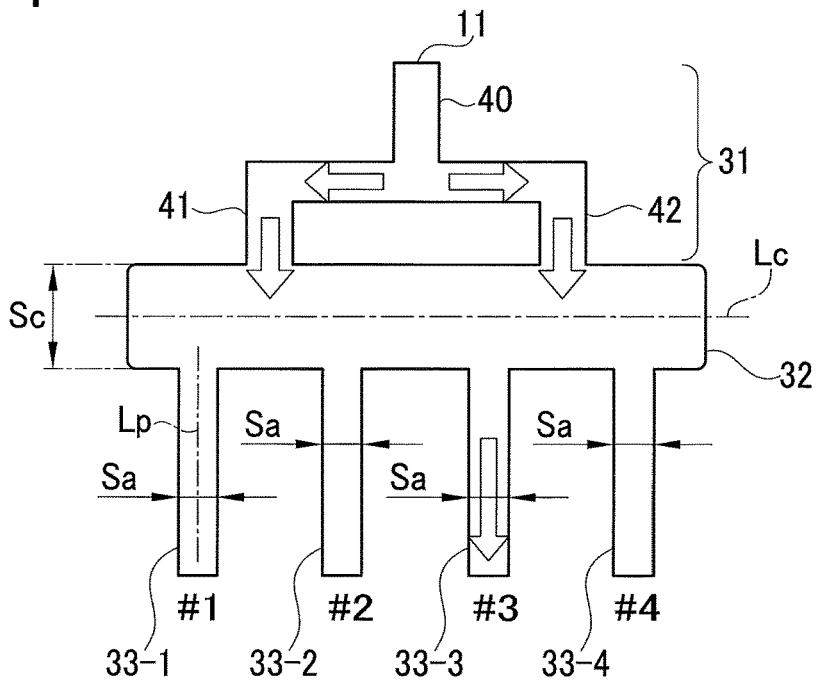
FIG. 4 is a schematic diagram of the gas passage in the present embodiment.

In the present embodiment, in contrast, the gas distribution unit 9 includes the EGR chamber 32 located upstream of the four EGR inflow ports 33 and connected to these EGR inflow ports 33 as shown in FIGS. 3 and 4. Accordingly, the first branch passage 41 and the second branch passage 42 join together once at the EGR chamber 32 and further connected to the four EGR inflow ports 33. Therefore the gas passage 8 of the gas distribution unit 9 is not divided into two passage groups such as the block A and the block B. Consequently, shifting of the intake stroke from the first cylinder #1 to the third cylinder #3 or shifting of the intake stroke from the fourth cylinder #4 to the second cylinder #2 is not performed as the aforementioned shifting across the block A and the block B. By the presence of the EGR chamber 32, the pressure variation in each EGR inflow port 33 is less likely to be transmitted to the first branch passage 41 and the second branch passage 42. Accordingly, during shifting of the intake stroke from the first cylinder #1 to the third cylinder #3, for example, the flow direction of EGR gas is not reversed between the first branch passage 41 and the second branch passage 42. Thus, the flow rate of EGR gas to the third EGR inflow port 33-3 does not decrease and thus the EGR rate in the third EGR inflow port 33-3 does not decrease. During shifting of the intake stroke from the fourth cylinder #4 to the second cylinder #2, similarly, the EGR rate in the second EGR inflow port 33-2 does not decrease.

Even when the valve opening times of the cylinders overlap each other in the intake stroke of each cylinder, the flow rate of EGR gas to each EGR inflow port 33 does not decrease and also the EGR rate in each EGR inflow port 33 does not decrease. For instance, during shifting of the intake stroke from the first cylinder #1 to the third cylinder #3, at the time when the valve opening times of the first cylinder #1 and the third cylinder #3 overlap each other and both the first cylinder #1 and the third cylinder #3 are brought into a negative pressure state, and the EGR rate in the third EGR inflow port 33-3 does not decrease and also the EGR rate in the third EGR inflow port 33-3 does not decrease. During shifting of the intake stroke from the fourth cylinder #4 to the second cylinder #2, similarly, the EGR rate in the second EGR inflow port 33-2 does not decrease.

Figure 5:
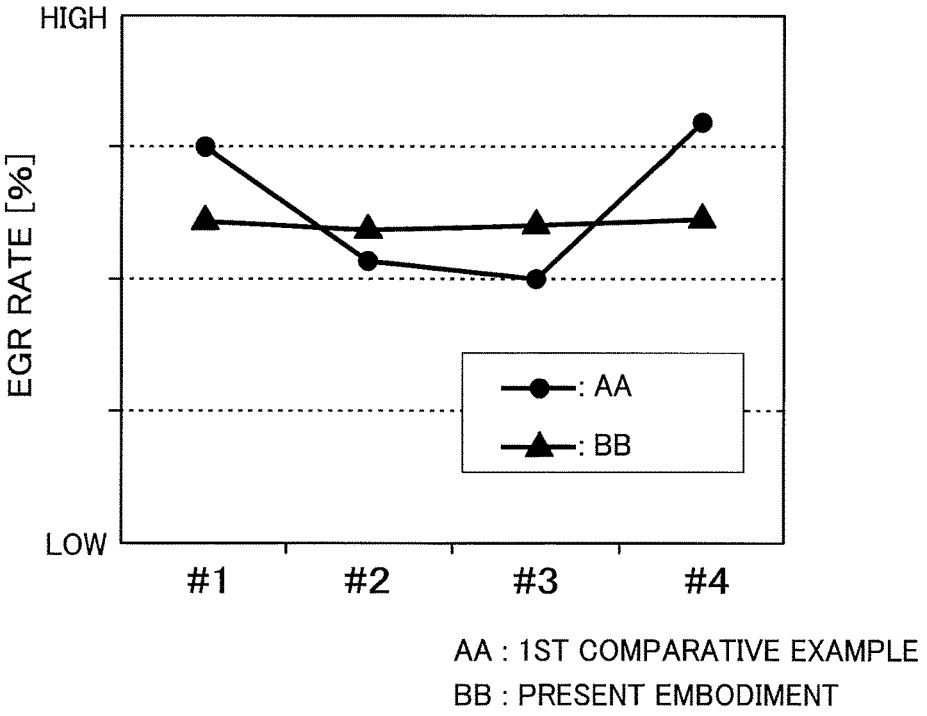
FIG. 5 is a graph showing an EGR rate in each cylinder.

In the present embodiment, as described above, the flow rate of EGR gas supplied to each EGR inflow port 33 does not vary, irrespective of the intake stroke of the engine, that is, without being influenced by the order of the cylinders to undergo air intake. The gas distribution unit 9 can therefore uniformly distribute EGR gas to each EGR inflow port 33 irrespective of the intake stroke of the engine. FIG. 5 shows the EGR rate in each of the cylinders connected to the EGR inflow ports 133 in the first comparative example and the cylinders connected to the EGR inflow ports 33 in the present embodiment. In the present embodiment, as shown in FIG. 5, the EGR rates less vary among the cylinders as compared with those in the first comparative example.

Next, a chamber cross-sectional area Sc of the EGR chamber 32 will be described below. Herein, the chamber cross-sectional area Sc is an area of a cross section of the EGR chamber 32 taken in a direction perpendicular to a central axis Lc of the EGR chamber 32. The chamber cross-sectional area Sc is one example of a "volume chamber cross-sectional area" in the invention.

Figure 14:
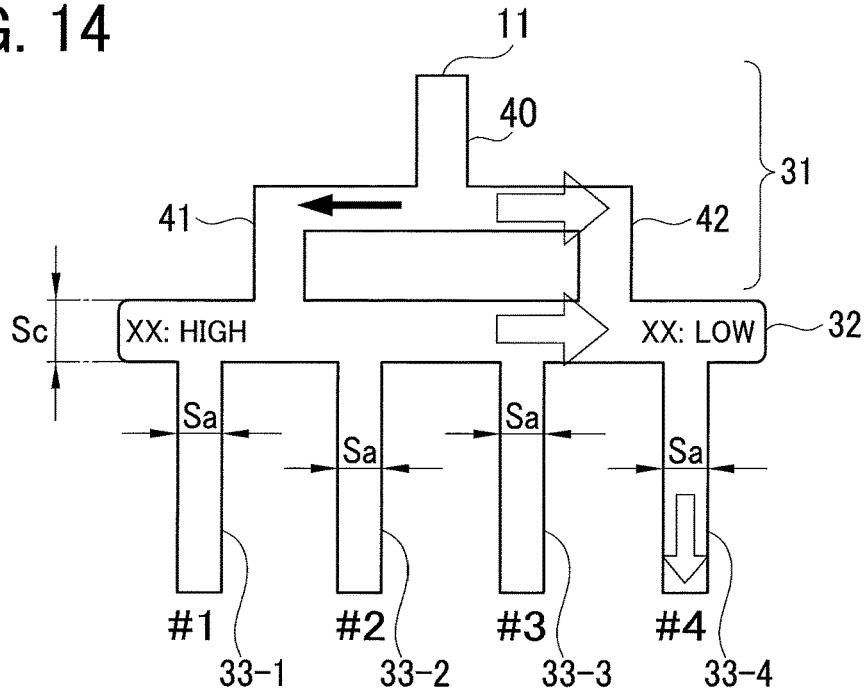
FIG. 14 is a schematic diagram of a gas passage in a second comparative example.
Figure 15:
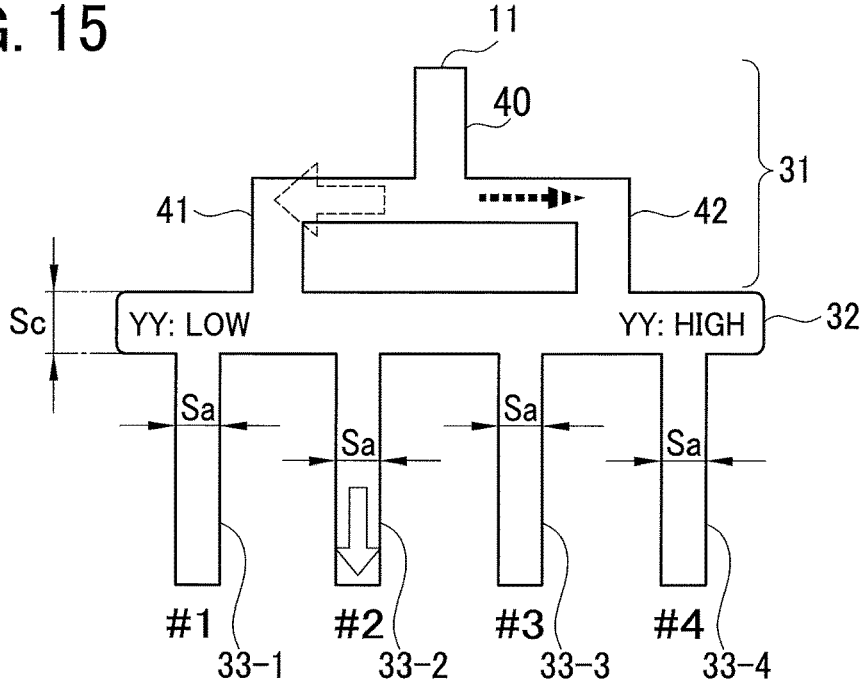
FIG. 15 is another schematic diagram of the gas passage in the second comparative example.

Firstly, a second comparative example is given on the presumption that the chamber cross-sectional area Sc is equal to a passage cross-sectional area Sa or slightly larger than the passage cross-sectional area Sa. The passage cross-sectional area Sa is an area of a cross section of the EGR inflow port 33 taken in a direction perpendicular to a central axis Lp of the EGR inflow port 33. In this case, as shown in FIG. 14, for example, when air is drawn into the fourth cylinder #4 during the intake stroke of the fourth cylinder #4, the pressure of a part of the EGR chamber 32 on a side close to the fourth EGR inflow port 33-4 is transitionally decreased due to the negative pressure applied to the fourth EGR inflow port 33-4. Accordingly, the EGR gas flow rate in the second branch passage 42 becomes larger than that in the first branch passage 41. Thus, the concentration of EGR gas in the EGR chamber 32 is higher on the side close to the fourth EGR inflow port 33-4 (the second branch passage 42), resulting in variation in distribution of EGR gas in the EGR chamber 32. Consequently, when the intake stroke is shifted to the second cylinder #2, as shown in FIG. 15, the flow rate of EGR gas allowed to flow to the second EGR inflow port 33-2 connected to the second cylinder #2 is low.

In the present embodiment, in contrast, the chamber cross-sectional area Sc is set sufficiently larger than the passage cross-sectional area Sa as shown in FIG. 4. Specifically, the chamber cross-sectional area Sc is designed to be large enough to prevent intake air in each cylinder of the engine from influencing the internal pressure of the EGR chamber 32. This can reduce a difference in flow rate between the first branch passage 41 and the second branch passage 42 and therefore reduce variation in distribution of EGR gas in the EGR chamber 32.

In the present embodiment, for instance, when air is drawn into the fourth cylinder #4 during the intake stroke of the fourth cylinder #4, the pressure in a part of the EGR chamber 32 on a side close to the fourth EGR inflow port 33-4 is less likely to decrease due to the negative pressure applied to the fourth EGR inflow port 33-4. Thus, a difference in flow rate does not occur between the first branch passage 41 and the second branch passage 42, so that the concentration of EGR gas is uniform throughout the EGR chamber 32 and the distribution of EGR gas is also uniform throughout the EGR chamber 32. When the intake stroke is shifted to the second cylinder #2, the flow rate of EGR gas allowed to flow to the second EGR inflow port 33-2 connected to the second cylinder #2 is not low. In this way, the flow rate of EGR gas to the EGR inflow ports 33 does not vary more effectively irrespective of the intake stroke of the engine. Therefore the gas distribution unit 9 can uniformly distribute EGR gas to each of the EGR inflow ports 33.

To study a preferable extent to which the chamber cross-sectional area Sc is set larger than the passage cross-sectional area Sa, the cylinder-to-cylinder EGR variation rate in the present embodiment is evaluated below. This cylinder-to-cylinder EGR variation rate is a value indicating a variation range of the EGR rate between the cylinders, more concretely, a value calculated by dividing a maximum variation range of the EGR rate between the cylinders by an average EGR rate of the cylinders. Herein, the average EGR rate between the cylinders is set to 20%. As a result, as shown in FIG. 6, the cylinder-to-cylinder EGR variation rate is about 8% or less when a value of "Chamber cross-sectional area Sc/Passage cross-sectional area Sa", that is, a value calculated by dividing the chamber cross-sectional area Sc by the passage cross-sectional area Sa, is 5 or more.

Figure 6:
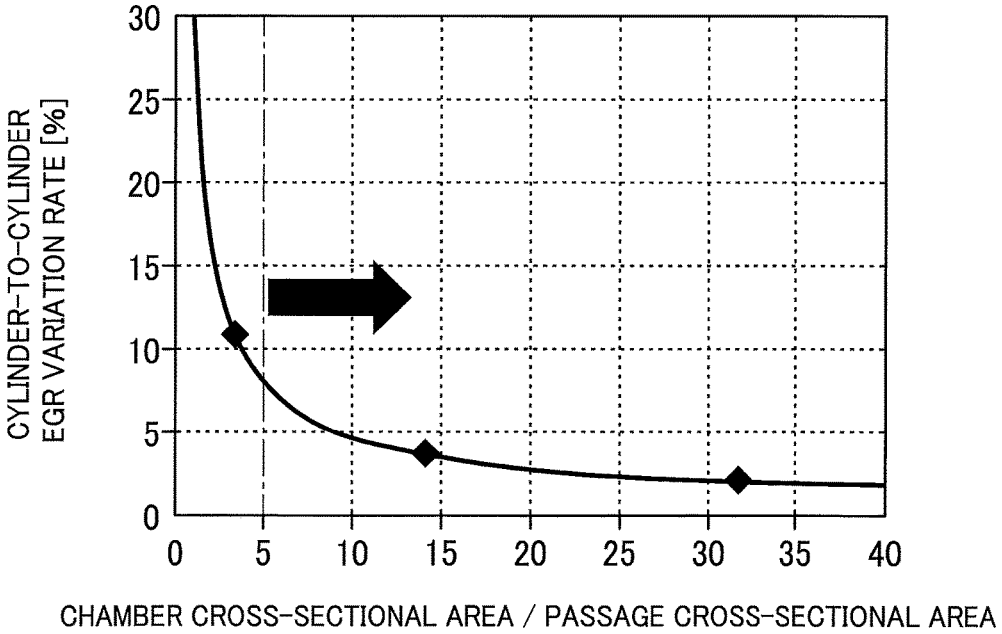
FIG. 6 is a graph showing evaluation results on a cylinder-to-cylinder EGR variation rate.

From the evaluation results shown in FIG. 6, it is preferable that the chamber cross-sectional area Sc is five or more times larger than the passage cross-sectional area Sa of each EGR inflow port 33. It is further preferable to adjust the size of the chamber cross-sectional area Sc according to average EGR rates different between the cylinders.

Figure 7:
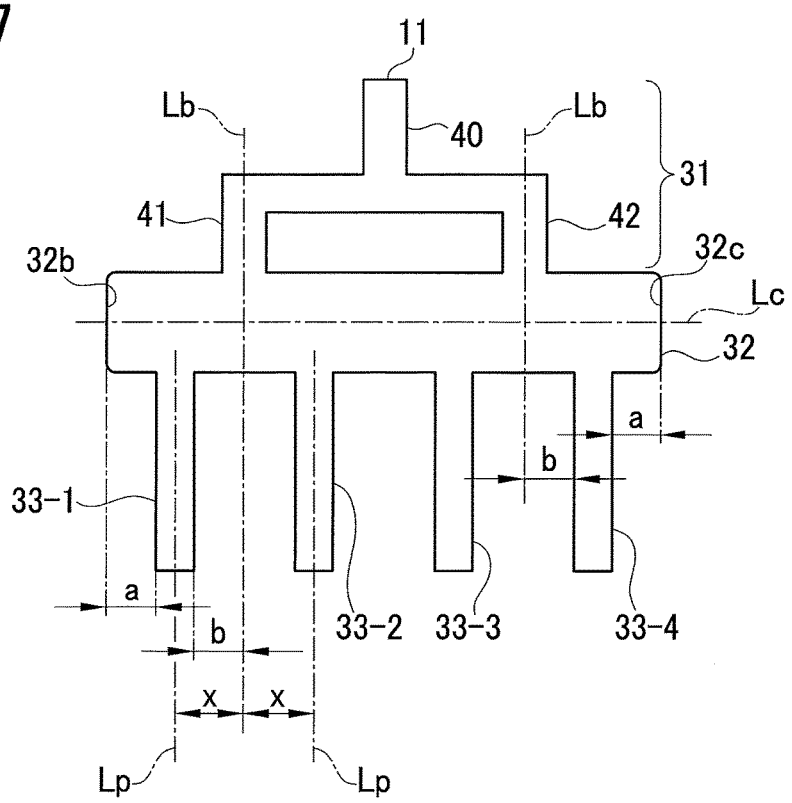
FIG. 7 is an explanatory diagram for arrangement of a first branch passage and a second branch passage.

In the present embodiment, as shown in FIG. 7, the branch passage part 31 has a shape extending from the gas inflow port 11 to the EGR chamber 32 by branching into two passages, namely, the first branch passage 41 and the second branch passage 42. The first branch passage 41 is placed, at its one end, in an intermediate position between the first EGR inflow port 33-1 and the second EGR inflow port 33-2. Specifically, a central axis Lb of the first branch passage 41 is located at a middle position between the central axis Lp of the first EGR inflow port 33-1 and the central axis Lp of the second EGR inflow port 33-2, i.e., in a position at a distance x from each central axis Lp, in the arrangement direction of the four EGR inflow ports 33, that is, in a direction of the central axis Lc of the EGR chamber 32. Similarly, the second branch passage 42 is placed in an intermediate position between the third EGR inflow port 33-3 and the fourth EGR inflow port 33-4.

In the above-configured branch passage part 31, the EGR gas introduced therein through the gas inflow port 11 is distributed through the EGR inflow passage 40 into the first branch passage 41 and the second branch passage 42 and thus two divided gas streams uniformly flow into the EGR chamber 32. Accordingly, the branch passage part 31 allows the EGR gas introduced through the gas inflow port 11 to uniformly disperse throughout the EGR chamber 32.

Figure 8:
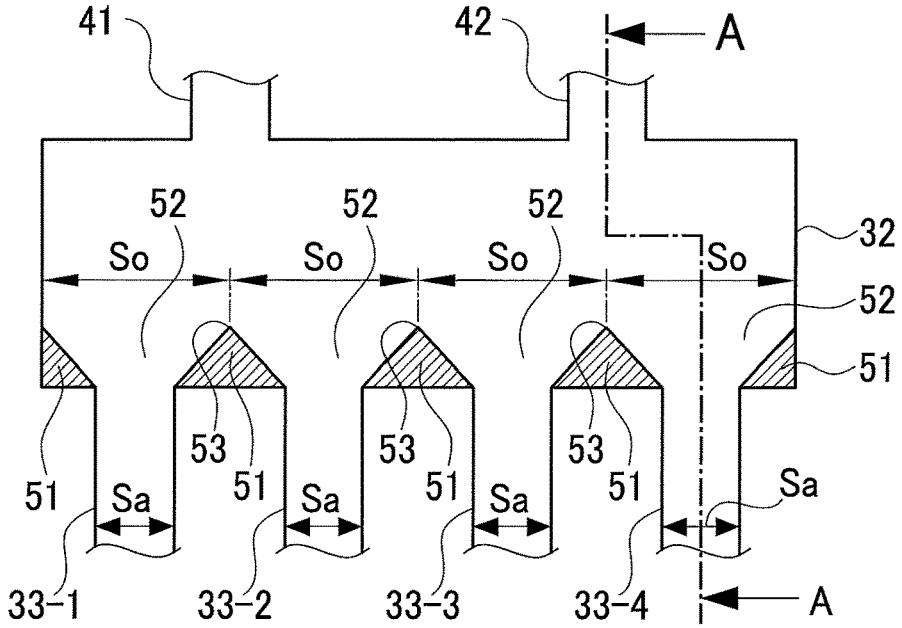
FIG. 8 is a schematic diagram showing that each EGR inflow port has an entrance portion formed in a funnel-like shape.

In the present embodiment, as shown in FIG. 8, the EGR chamber 32 includes connecting parts 51 connected to the EGR inflow ports 33. Those connecting parts 51 are formed with openings 52 as a funnel-shaped entrance portion of each EGR inflow port 33. Each of the openings 52 has an opening area So larger than the passage cross-sectional area Sa of each of the EGR inflow ports 33.

Accordingly, the condensed water deriving from the EGR gas cooled in the EGR chamber 32 (hereinafter, as appropriate, simply referred to as "condensed water") is allowed to smoothly flow from the EGR chamber 32 to the EGR inflow ports 33. Thus, the condensed water is less likely to accumulate in the EGR chamber 32.

Since the entrance portion of each EGR inflow port 33 has a funnel-like shape as shown in FIG. 8, resistance can be imposed to the EGR gas flow in each EGR inflow port 33 so that a flow rate of EGR gas in a backflow direction (from each EGR inflow port 33 toward the EGR chamber 32) is smaller than a flow rate of EGR gas in an inflow direction (from the EGR chamber 32 to each EGR inflow port 33). This makes it possible to reduce an inflow amount of fresh air into the EGR chamber 32 caused by intake pulsation of the engine and thus suppress variation in concentration distribution of the EGR gas in the EGR chamber 32.

Further, the openings 52 are located in one-to-one correspondence with the EGR inflow ports 33 and include circumferential edge portions 53 adjacent to each other as shown in FIG. 8. In other words, the connecting part 51 defining the entrance portion of each EGR inflow port 33 has a taper shape, so that an apex of a triangular section of each connecting part 51 forms the circumferential edge portions 53 of the adjacent openings 52. This makes it easy to uniformly distribute water, such as the condensed water, from the EGR chamber 32 into the four EGR inflow ports 33. Thus, the condensed water can be prevented from accumulating in the EGR chamber 32. Furthermore, the condensed water can be prevented from instantaneously flowing in a specified one of the EGR inflow ports 33 to avoid misfire of an engine.

Figure 9:
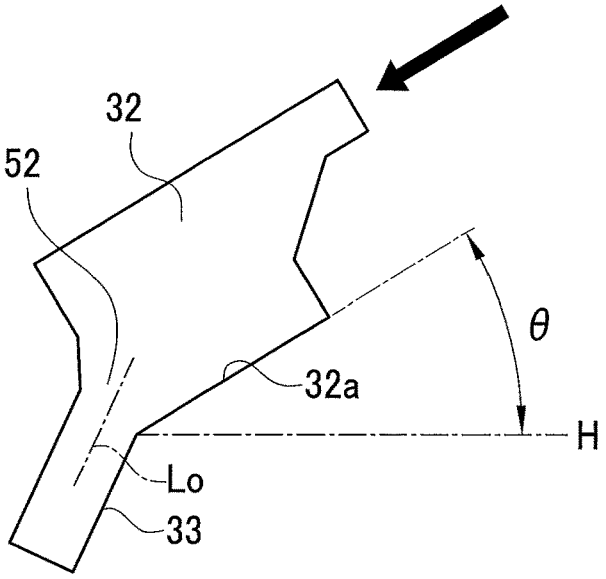
FIG. 9 is a cross-sectional view taken along a line A-A in FIG. 8, i.e., a diagram showing a state in which an intake manifold is mounted on an engine.

Moreover, as shown in FIG. 9, a bottom surface 32*a* of the EGR chamber 32 and a central axis Lo of the opening 52 are inclined at respective predetermined angles toward the ground, that is, toward a lower part of the intake manifold 1 while the intake manifold 1 is in a use state (in which the intake manifold 1 is attached to the engine and this engine is installed in a vehicle). In this manner, the bottom surface of the EGR chamber 32 continuous with the EGR inflow ports 33 is inclined at a predetermined angle θ (θ>0°) with respect to a horizontal line H in FIG. 9 in consideration of an installation state in an engine, a parking state of a vehicle on a sloping place, and others. The central axis Lo of the opening 52 is inclined at a predetermined angle with respect to the horizontal line H in FIG. 9. This configuration makes it easy to smoothly flow the condensed water, which is the water deriving from the gas, from the EGR chamber 32 to the EGR inflow ports 33. The condensed water can thus be prevented from accumulating in the EGR chamber 32.

Figure 10:
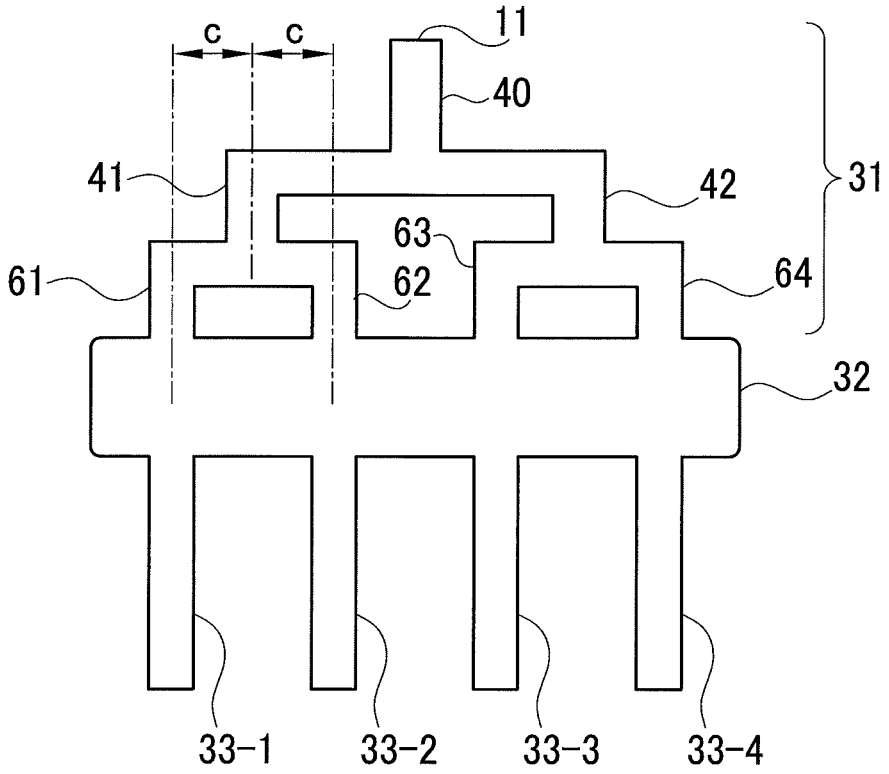
FIG. 10 is a schematic diagram of a gas passage in a modified example.

The gas passage 8 may be designed in any shape or pattern as long as it can uniformly distribute the EGR gas to the EGR inflow ports. For instance, a modified example shown in FIG. 10 is also available. In this modified example, the first branch passage 41 is branched into two branch passages; a first-A branch passage 61 and a first-B branch passage 62. These branch passages 61 and 62 are connected to the EGR chamber 32. The second branch passage 42 is branched into two branch passages; a second-A branch passage 63 and a second-B branch passage 64. These branch passages 63 and 64 are connected to the EGR chamber 32.

In the modified example shown in FIG. 10, as described above, the branch passage part 31 is designed in a shape extending from the gas inflow port 11 to the EGR chamber 32 by branching into two passages at each of multiple stages (at each of two stages in this example). Further, the first-A branch passage 61, the first-B branch passage 62, the second-A branch passage 63, and the second-B branch passage 64 are placed respectively just above the first EGR inflow port 33-1, the second EGR inflow port 33-2, the third EGR inflow port 33-3, and the fourth EGR inflow port 33-4. In addition, the first branch passage 41 is placed in an intermediate position between the first-A branch passage 61 and the first-B branch passage 62. The second branch passage 42 is placed in an intermediate position between the second-A branch passage 63 and the second-B branch passage 64.

The gas distribution unit 9 in the present embodiment includes, as described above, the EGR inflow ports 33 connected one to each of the plurality of branch pipes 4 of the intake unit 5 provided with a collecting pipe 3 and the branch pipes 4, the EGR chamber 32 located on the upstream side of and connected to the four EGR inflow ports 33, and the branch passage part 31 located on the upstream side of and connected to the EGR chamber 32. The branch passage part 31 is configured to allow EGR gas introduced therein through the gas inflow port 11 to be uniformly distributed and introduced into the EGR chamber 32.

According to the gas distribution unit 9 in the present embodiment, it is possible to uniformly introduce EGR gas into the EGR chamber 32 through the branch passage part 31 and therefore achieve uniform distribution of EGR gas in the EGR chamber 32. The gas distribution unit 9 can thus uniformly distribute the EGR gas from the EGR chamber 32 to the four EGR inflow ports 33. Consequently, irrespective of the intake stroke of the engine, the gas distribution unit 9 can uniformly distribute the EGR gas to the cylinders of the engine through the branch pipes 4.

In the gas distribution unit 9 of the present embodiment, the branch passage part 31 has a shape extending from the gas inflow port 11 to the EGR chamber 32 by branching into two branches. Accordingly, it is possible to more effectively introduce EGR gas into the EGR chamber 32 through the branch passage part 31 to uniformly distribute the EGR gas throughout the EGR chamber 32.

The EGR chamber 32 includes the connecting parts 51 connected to the EGR inflow ports 33 and formed with the openings 52 each having the opening area So larger than the passage cross-sectional area Sa of each EGR inflow port 33. This configuration facilitates flowing of the condensed water from the EGR chamber 32 to each EGR inflow port 33, so that the condensed water is less likely to accumulate in the EGR chamber 32. Further, this configuration can reduce an inflow amount of fresh air (gas other than EGR gas) into the EGR chamber 32 caused by intake pulsation of the engine and thus suppress variation in concentration distribution of the EGR gas in the EGR chamber 32. Since the opening area So and the passage cross-sectional area Sa are determined at the ratio appropriately adjusted as above, the gas distribution unit 9 can provide finely adjusted performance for distribution of EGR gas from the EGR chamber 32 to the EGR inflow ports 33.

Further, the openings 52 are located in one-to-one correspondence with the EGR inflow ports 33 and include the circumferential edge portions 53 adjacent to each other. This configuration makes it easy to uniformly distribute the condensed water from the EGR chamber 32 to the plurality of EGR inflow ports 33. Thus, the condensed water can be prevented from accumulating in the EGR chamber 32. Furthermore, the condensed water can be prevented from instantaneously flowing in a specified one of the EGR inflow ports 33 to avoid misfire of an engine.

Moreover, the EGR chamber 32 includes the bottom surface 32*a* and the openings 52 in the connecting parts 51 connected to the EGR inflow ports 33, the bottom surface 32*a* and the central axis Lo of each opening 52 being inclined toward the ground while the intake manifold 1 is in a use state. Accordingly, during use of the intake manifold 1, the condensed water can be prevented from accumulating in the EGR chamber 32.

The EGR chamber 32 has the cross-sectional area Sc which is five or more times larger than the passage cross-sectional area Sa of each EGR inflow port 33. This can more reliably uniformly distribute EGR gas from the EGR chamber 32 to the four EGR inflow ports 33.

Further, the gas distribution unit 9 is formed integrally with the intake unit 5. This configuration can improve assembling easiness of the gas distribution unit 9 to the engine.

The cross section of the EGR chamber 32 taken in a direction perpendicular to its central axis Lc has a rectangular shape. Accordingly, the EGR chamber 32 can be reduced in size and thus the intake manifold 1 can be downsized.

Further, as shown in FIG. 7, it is preferable to set a distance a larger than a distance b. Herein, the distance a indicates a distance between one end face 32*b* of the EGR chamber 32 in a direction along the central axis Lc of the EGR chamber 32 and the first EGR inflow port 33-1 and also a distance between the other end face 32*c* of the EGR chamber 32 in the direction along the central axis Lc and the fourth EGR inflow port 33-4. The distance b indicates a distance between the first EGR inflow port 33-1 and the central axis Lb of the first branch passage 41 and also a distance between the fourth EGR inflow port 33-4 and the central axis Lb of the second branch passage 42.

The foregoing embodiments are mere examples and give no limitation to the present invention. The present invention may be embodied in other specific forms without departing from the essential characteristics thereof.

REFERENCE SIGNS LIST

1 Intake manifold
3 Collecting pipe
4 Branch pipe
5 Intake unit
8 Gas passage
9 Gas distribution unit
11 Gas inflow port
31 Branch passage part
32 EGR chamber
33 EGR inflow port
33-1 First EGR inflow port
33-2 Second EGR inflow port
33-3 Third EGR inflow port
33-4 Fourth EGR inflow port
40 EGR inflow passage
41 First branch passage
42 Second branch passage
51 Connecting part
52 Opening
53 Circumferential portion
So Opening area
Sa Passage cross-sectional area
Sc Chamber cross-sectional area

What is claimed is:

1. A gas distribution apparatus comprising:

a gas inflow port that is configured to introduce gas into the gas distribution apparatus;

a plurality of downstream-side gas distributing passages that are each configured to be connected to one of a plurality of branch pipes of an intake unit that is provided with a collecting pipe, the plurality of branch pipes branching off from the collecting pipe;

a single volume chamber that is located on an upstream side of the plurality of downstream-side gas distributing passages and that is connected to each of the plurality of downstream-side gas distributing passages so that the downstream-side gas distributing passages each form a separate and distinct passage from the other downstream-side gas distributing passages and are each separately connected to the volume chamber; and an upstream-side gas distributing passage that is located on an upstream side of the volume chamber, the upstream-side gas distributing passage being connected on one end side to the gas inflow port and connected on another end side to the volume chamber, and the upstream-side gas distributing passage being configured to allow the gas introduced through the gas inflow port to be uniformly distributed and introduced into the volume chamber.

2. The gas distribution apparatus according to claim 1, wherein the upstream-side gas distributing passage has a shape that either (i) extends from the gas inflow port to the volume chamber by branching into two passages or (ii) extends from the gas inflow port to the volume chamber by branching into two passages at each of multiple stages.

3. The gas distribution apparatus according to claim 1, wherein the volume chamber includes a connecting part connected to the downstream-side gas distributing passages, the connecting part including a plurality of openings, each of the openings having an opening area larger than a passage cross-sectional area of each of the downstream-side gas distributing passages.

4. The gas distribution apparatus according to claim 3, wherein the openings are located in one-to-one correspondence with the downstream-side gas distributing passages and include circumferential edge portions adjacent to each other.

5. The gas distribution apparatus according to claim 1, wherein the volume chamber includes a connecting part connected to the downstream-side gas distributing passages, the connecting part including a plurality of openings, and a bottom surface of the volume chamber and the openings of the volume chamber are inclined at respective predetermined angles toward a ground while the gas distribution apparatus is in a use state.

6. The gas distribution apparatus according to claim 1, wherein the volume chamber has a cross section taken in a direction perpendicular to a central axis of the volume chamber so that the cross section has a cross-sectional area five or more times larger than a passage cross-sectional area of each of the downstream-side gas distributing passages.

7. The gas distribution apparatus according to claim 1, wherein the gas distribution apparatus is formed integrally with the intake unit.

8. The gas distribution apparatus according to claim 1, wherein the upstream-side gas distributing passage is divided on the another end side into a plurality of branch passages, and each of the plurality of branch passages are connected to the single volume chamber.

* * * * *